US005388923A

United States Patent [19]

Dubois et al.

[11] Patent Number: 5,388,923

[45] Date of Patent: Feb. 14, 1995

[54] ERGONOMIC PRINTER FOR USE IN AIRCRAFT COCKPITS

[75] Inventors: Marcel Dubois, Le Chesnay; Jacques Ribeiro, Igny, both of France

[73] Assignee: Sextant Avionique, Meudon la Foret, France

[21] Appl. No.: 897,160

[22] Filed: Jun. 11, 1992

[30] Foreign Application Priority Data

Jun. 11, 1991 [FR] France ..... 91 07054

[51] Int. Cl.[6] ..... B41J 15/04

[52] U.S. Cl. ..... 400/613.1; 400/618; 242/596.7; 242/596.8

[58] Field of Search ..... 400/613.1, 613.3, 617, 400/618, 636, 642, 249, 234, 613, 619; 242/596.7, 596.8, 598.5, 599.3, 613.1, 613.2

[56] References Cited

U.S. PATENT DOCUMENTS 4,013,160 3/1977 Colecchi et al. ..... 400/234
4,663,638 5/1987 Hirose ..... 346/136
5,005,595 3/1991 Koike et al. ..... 400/588

FOREIGN PATENT DOCUMENTS 0279530 2/1987 European Pat. Off. .
0401036 12/1990 European Pat. Off. .
2552541 9/1984 France .
2171082 8/1986 United Kingdom .

*Primary Examiner*—Ren Yan
*Attorney, Agent, or Firm*—Browdy and Neimark

[57] ABSTRACT

An ergonomic printer suitable for use in an aircraft cockpit includes a polarizing arrangement preventing a paper roll being inserted in a support the wrong way around and a paper extraction arrangement which operates on the paper roll in a region thereof substantially opposite an access orifice. The paper extraction arrangement is associated with a guide arrangement for feeding the paper successively to a feed device, a print station and an outlet slot in a front wall of the printer. The printer may be flush-mounted in a wall of the cockpit of an aircraft.

11 Claims, 5 Drawing Sheets

ERGONOMIC PRINTER FOR USE IN AIRCRAFT COCKPITS

BACKGROUND OF THE INVENTION

1. Field of the Invention

The present invention concerns an ergonomic printer which can be used in the cockpit of an aircraft, for example.

2. Description of the Prior Art

Printers are increasingly used for pilot/onboard computer dialogue in aircraft.

The printer is used to print messages or diagrams (a flight plan or a map, for example) without disturbing the information shown on the cockpit displays.

Conventional printers require complex operations that are difficult for a pilot seated at the controls of an aircraft who rarely has both hands free at the same time.

This is particularly so in the case of operations to load and unload the printer and to clear a paper jam.

The paper used in this type of printer is in the form of a continuous roll.

To load the printer the paper roll must be inserted into a magazine and its free end must be correctly inserted into the feed and guide system which passes the paper into the printing area of the printer (the area in which a print head moves).

This loading operation, which requires the use of both hands, is made all the more difficult in that the end of the roll is rarely cut off straight and is frequently torn and ragged.

The introduction of this ragged edge into the access orifice of the guide system (usually a narrow slot) is therefore particularly difficult.

A particular object of the invention is to eliminate these drawbacks by providing a printer whose design and operation are specifically conceived so that all operations, including loading and clearing of jams, can be carried out with one hand only and engage the attention of the pilot for only a very short time.

SUMMARY OF THE INVENTION

The present invention consists in an ergonomic printer suitable for use in the cockpit of an aircraft comprising, delimited by a support structure, a magazine adapted to contain a roll of paper and comprising means for supporting said roll which enable it to rotate freely about a predetermined axis, said roll being inserted into said magazine through an access orifice in a front wall of the printer through which rolls can be moved in translation whilst remaining in a position substantially parallel to said axis, the printer comprising polarizing means preventing said paper roll being inserted in said support means the wrong way around and paper extraction means which operate on said paper roll in a region thereof substantially opposite said access orifice, said paper extraction means being associated with guide means for feeding said paper successively to a feed device, a print station and an outlet slot in said front wall, near the access orifice, said outlet slot possibly comprising paper cutting means.

The extractor means advantageously comprise a deflector whose anterior edge bears on the paper roll along a generatrix thereof. In this case, contact is maintained between this edge and the paper roll during unwinding:

either by providing means for enabling movement in translation of the paper roll so that it is located against said edge by its own weight, or by using an elastically deformable deflector.

The guide means associated with said deflector may comprise a first guide plate aligned with the deflector and a second guide plate constituting the bottom of the magazine, for example, the second plate delimiting with the combination of the deflector and the first plate an intermediate space of decreasing thickness in which the paper moves.

The drive means may comprise a conventional capstan roller driven by a stepper motor and directly associated with a print head (a thermal print head, for example).

The access orifice to said paper magazine is advantageously closed by a hinged lid which delimits at least partly the slot and which cooperates with a microswitch and the printer comprises advantageously a paper present sensor at the entry of the print device.

The feed means of the printer may be controlled by a microprocessor programmed to instruct a paper loading cycle comprising the following stages:

- opening of the lid and insertion of the paper roll into the magazine,
- insertion of the free end of the paper in the guide means by simple manual rotation of the paper roll until it is engaged with the feed means and is sensed by the paper present sensor,
- a first actuation of the feed means initiated by said detection to feed a sufficient length of paper for its free end to emerge visibly into the magazine,
- closing of the lid which by operating the microswitch reverses the feed means initially to retract the paper and subsequently feeds the paper again to a start of printing position with its end inserted in the slot.

It is clear that the loading method has the advantage of requiring only extremely simple manual operations demanding the attention of the operator for only very short time periods.

Furthermore, before closing the cover the operator can check that the paper is correctly inserted and that there is no jamming of the paper.

The duplicated retraction/advance displacement then eliminates any possible onset of jamming and ensures that the paper follows the correct path in the printer.

Another important advantage of this printer is that it does not require the end of the paper roll to be cut cleanly at right angles to enable paper loading. The paper roll end can be cut or even torn in any way.

One embodiment of the invention is described hereinafter by way of non-limiting example only with reference to the appended drawings.

DETAILED DESCRIPTION OF THE INVENTION

Figure 1:
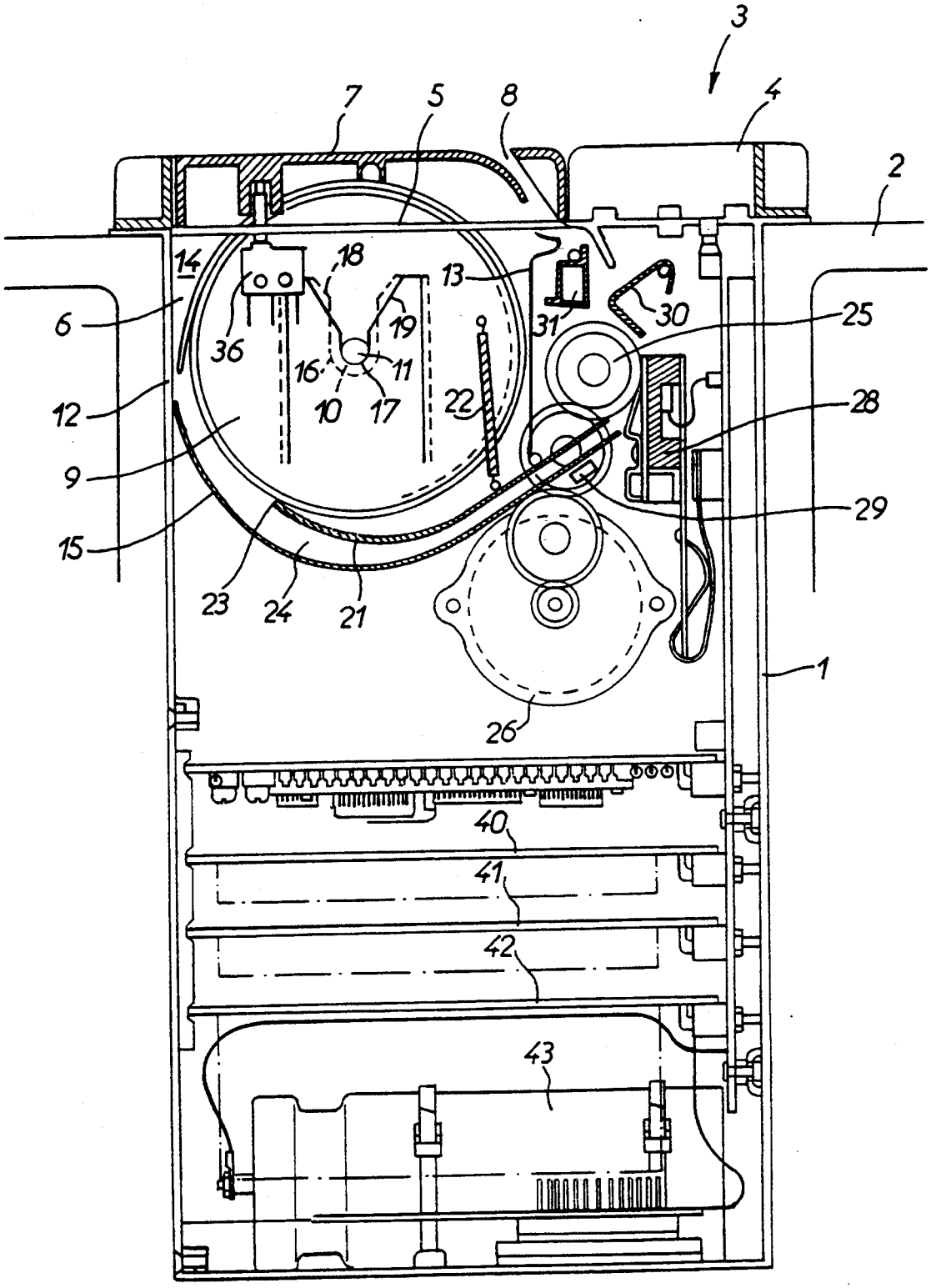
FIG. 1 is a view in transverse cross-section of a printer in accordance with the invention.

In this example the printer is mounted inside a substantially parallelepiped-shape casing 1. It is designed to be flush-mounted in a housing provided for this purpose in a panel 2 in the cockpit of an aircraft so that only the front panel 3 of the printer is visible and accessible to the pilot.

The front panel 3 comprises on one side a printer control panel 4 carrying the various control and display devices and on the other side an orifice 5 providing access to a paper magazine 6.

The orifice 5 can be covered by a lid 7 hinged to the control panel 4 and incorporating a paper slot 8.

Figure 6:
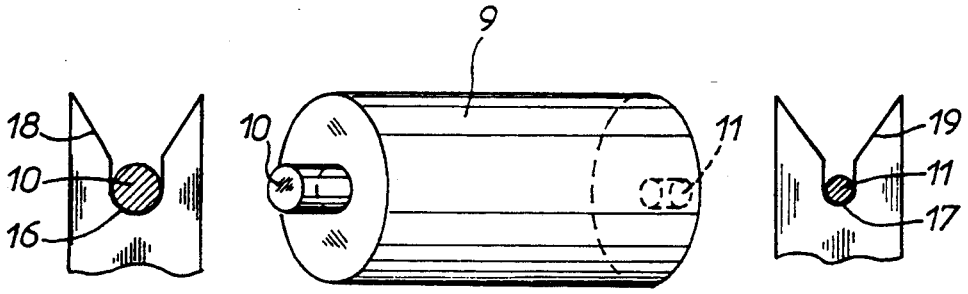
FIG. 6 shows a paper roll in perspective with, developed in the plane of the figure, the profiles of polarized rotary mounting members for the paper roll.

The orifice 5 is naturally large enough to admit a paper roll 9 fitted with its support journals 10, 11, like that shown in FIG. 6, for example.

The paper magazine 6 has a rectangular shape in horizontal cross-section substantially the same size as the orifice 5 constituting its upper side.

It has two substantially vertical parallel longitudinal sides 12, 13, two transverse sides 14 and a curved bottom 15 whose concave side faces towards the interior of the magazine 6.

The two transverse sides 14 of the magazine 6 comprise respective substantially coaxial half-bearings 16, 17 open upwardly and adapted to receive the support journals 10, 11 of the paper roll 9.

Each of the two half-bearings 16, 17 is extended upwardly by diverging ribs 18, 19 which guide the support journals 10, 11 into the half-bearings when loading paper (FIG. 6).

To ensure that paper can feed from the roll 9 inside the magazine 6 in one direction only, the two support journals 10, 11 and the respective two half-bearings 16, 17 have different diameters.

Parallel to the bottom 15 is a curved deflector 21 hinged to the longitudinal side 13 of the magazine 6 and spring-loaded by a spring 22 so that its edge 23 (that opposite the hinge) is applied at all times to a generatrix of the paper roll 9, irrespective of the diameter of the paper roll 9.

With the bottom 15, the deflector 21 delimits an intermediate space 24 into which the paper is guided towards a paper feed device associated with a print device.

In this example the feed device is a conventional type capstan roller 25 driven by a stepper motor-gearbox 26 through gears. The print device incorporates a print head 28 movable along a generatrix of the capstan roller 25.

A paper present sensor 29 is provided at the entry to the combination of the capstan roller 25 and the print head 28.

At the exit from this combination the paper is guided between the mobile and fixed blades 30, 31 of a cutter towards an outlet slot 8 in the lid 7.

An end of travel switch 36 senses the closed position of the lid 7.

The electronic circuits controlling the printer are carried by printed circuit boards disposed in the space between the bottom of the magazine and the bottom of the casing. In this example, these circuits comprise a central processor unit board 41, an extension board 40 and a power supply board 42 associated with a filter capacitor 43.

The process of loading the printer previously described comprises the following phases shown in FIGS. 2 through 5:

In a first phase, the operator opens the lid 7 and inserts a paper roll 9 into the magazine 6 so that the support journals 10, 11 engage in the respective half-bearings 16, 17. In this position the free edge 23 of the deflector 21 bears on a generatrix of the paper roll 9.

Figure 2:
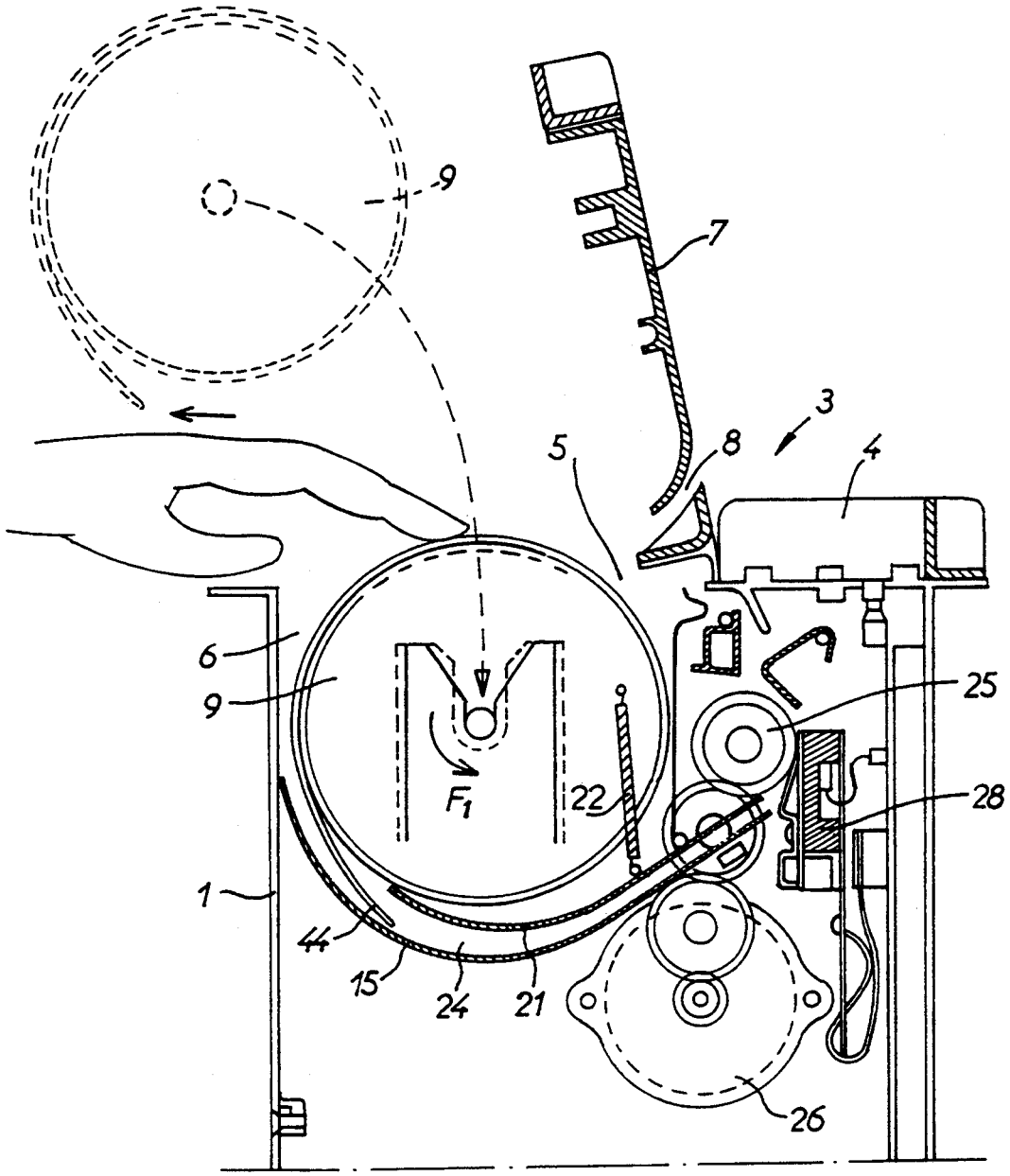
FIGS. 2 through 5 are diagrammatic representations of the printer shown in FIG. 1 showing various phases of its operation.
Figure 3:
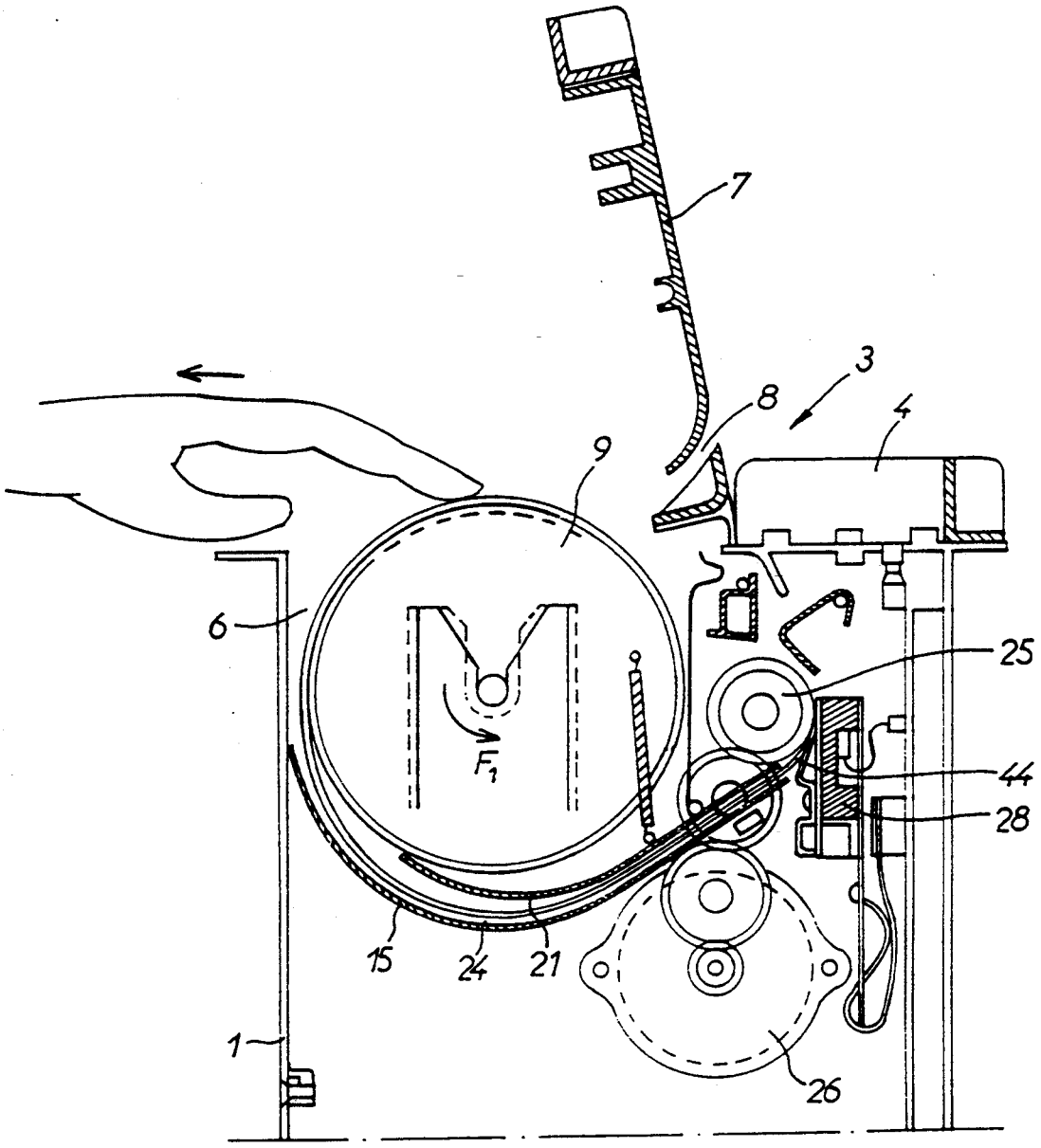

On completing this operation, the operator rotates the paper roll 9 in the direction of the arrow F1 so that the free end 44 of the paper is inserted into and guided by the intermediate space 24 between the deflector 21 and the bottom 15 (FIG. 2).

The operator continues this action until the end 44 of the paper is inserted between the capstan roller 25 and the print head 28.

In this position the sensor 29 senses that the paper is present and causes the motor 26 to turn in the paper feed direction.

Figure 4:
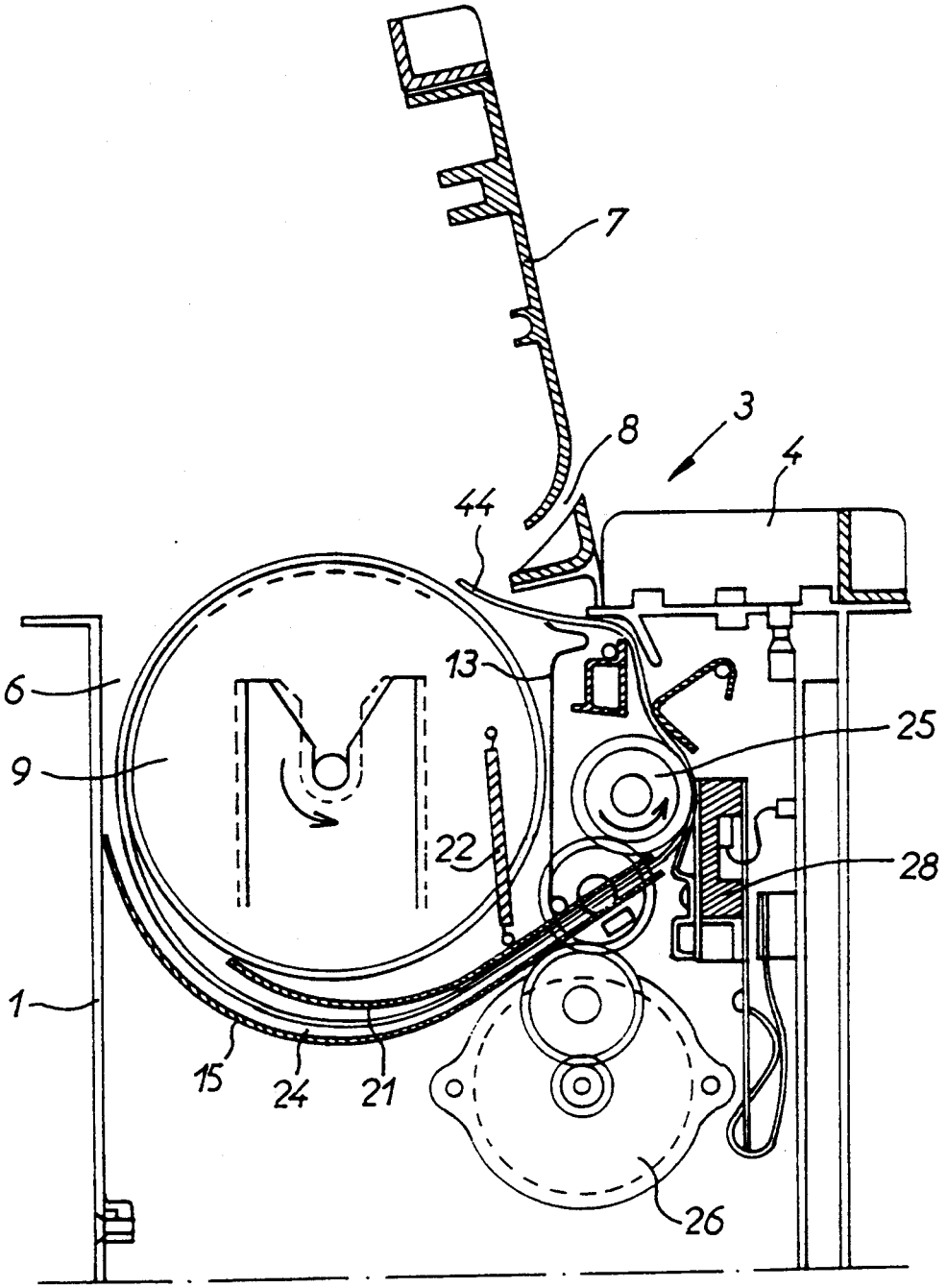
Figure 5:
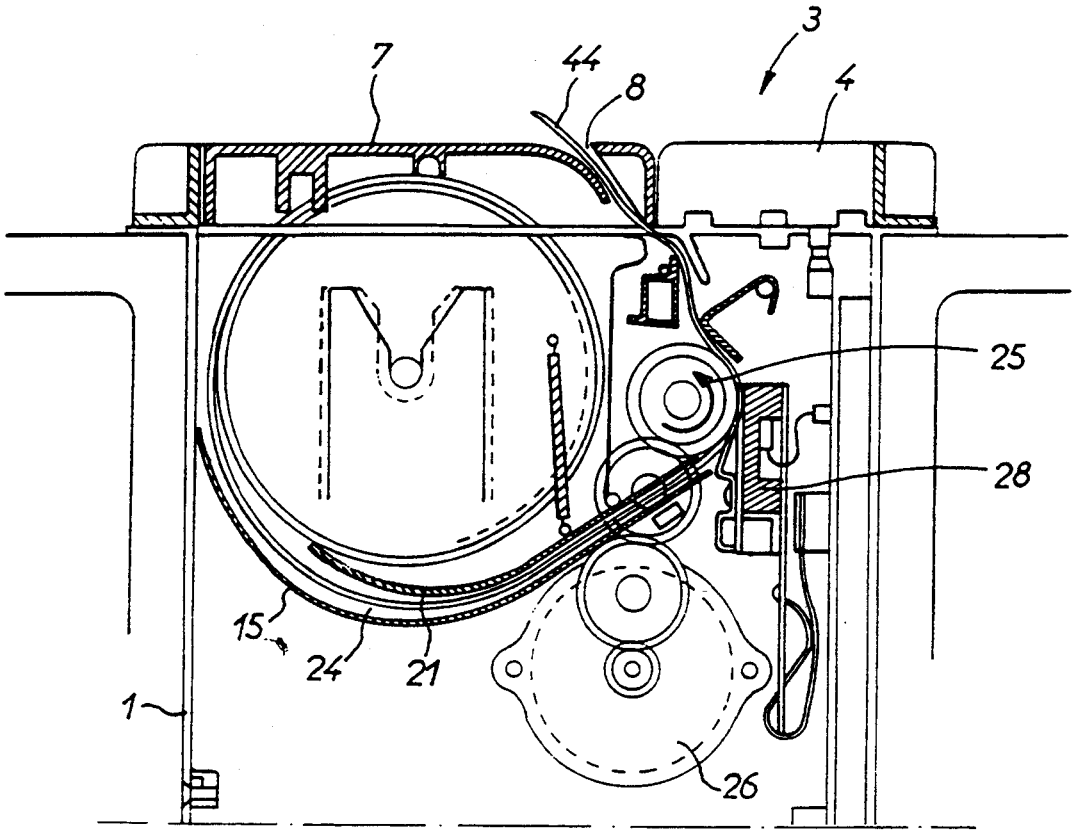

The capstan roller 25 feeds the paper until it reaches a position visible in the magazine 6 (FIG. 4). The motor 26 is stopped and the lid 7 is closed.

The fully closed lid 7 operates the switch 36 which commands a cycle of operation of the stepper motor 26 comprising:

- a first phase in which the motor 26 runs in the reverse direction until the free edge of the paper is exactly at the exit from the capstan roller 25,
- a second phase in which the motor 26 runs in the forward direction to move the paper to a start of printing position with its free edge 44 extending through the outlet slot 8.

The printer is then ready to be used.

The control panel 4 may advantageously comprise, in addition to the conventional on/off switch, cutter operating switch, etc, a control initiating a jam clearing process.

When operated, this control could initiate a forward-/reverse sequence of operation of the motor 26 until the jam is cleared.

There is claimed:

1. Ergonomic printer suitable for use in the cockpit of an aircraft comprising a print station, a paper feed device, and:

- a support structure delimiting a magazine having a bottom and having an upper front wall provided with an opening through which a roll of paper being engaged into said magazine in a loading operation,
- two coaxial support journals provided on said paper roll and having respectively first and second different diameters,
- two half-bearings open upwards, coaxial to a rotational axis, and having diameters matching respectively said first and second diameters, said half-bearings being disposed in said magazine to engage said support journals for supporting said paper roll, enabling said paper roll to rotate freely about said rotational axis,
- diverging ribs extending upwards from each of said half-bearings for guiding said support journals into the half-bearings during said loading operation while said roll effects a downward translational movement and remains in a position substantially parallel to said rotational axis,
- paper extraction means which operate on said paper roll in a region thereof substantially opposite said opening for extracting a paper end from said roll, said paper extraction means delimiting with a face of the magazine opposite to said upper front wall a paper path where the paper is guided successively to said paper feed device for feeding said paper, said print station where said paper is printed, and an outlet slot formed in said upper front wall and through which the paper end exits from said support structure.

2. Printer according to claim 1, wherein said paper extraction means comprise a deflector having an anterior edge which bears on said paper roll along a generatrix thereof and delimiting with the bottom of said magazine said paper path.

3. Printer according to claim 2, further comprising resilient means maintaining contact between said anterior edge and said paper roll during unwinding, and enabling movement of said anterior edge in translation of said paper roll.

4. Printer according to claim 2, wherein said deflector is elastically deformable for maintaining contact between said anterior edge and said paper roll during unwinding.

5. Printer according to claim 2, wherein said deflector is hinged to a longitudinal face of the magazine and is spring-loaded against said paper roll.

6. Printer according to claim 2, wherein said paper extraction means comprise a first guide plate aligned with said deflector and a second guide plate constituting the bottom of said magazine, said second guide plate delimiting with the combination of said deflector and said first guide plate an intermediate space of decreasing thickness in which said paper moves.

7. Printer according to claim 1, further comprising a hinged lid which closes said opening and delimits at least partly said outlet slot.

8. Printer according to claim 7, comprising a switch adapted to sense the closed position of said lid.

9. Printer according to claim 8, comprising a paper present sensor disposed upstream from the print station and a central processor unit connected to said paper present sensor, said switch and said feed device, and programmed to actuate said feed device so as to feed a sufficient length of said paper so as to permit a free end thereof to emerge visibly above said paper roll when said sensor detects paper and said lid is open, and to retract said paper and subsequently to feed said paper again to a start of printing position with its end inserted in said outlet slot when said switch is operated by closing said lid.

10. Printer according to claim 1, comprising a paper present sensor disposed upstream from said print station.

11. Printer according to claim 1, comprising jam clearing control means adapted to initiate a forward-/reverse sequence of movement of said paper feed device.

* * * * *